United States Patent [19]

Simm et al.

[11] Patent Number: 4,507,151

[45] Date of Patent: Mar. 26, 1985

[54] COATING MATERIAL FOR THE FORMATION OF ABRASION-RESISTANT AND IMPACT-RESISTANT COATINGS ON WORKPIECES

[75] Inventors: Wolfgang Simm, Ecublens; Hans-Theo Steine, Chavannes, both of Switzerland

[73] Assignee: Castolin S.A., Saint-Sulpice, Switzerland

[21] Appl. No.: 403,620

[22] PCT Filed: Nov. 20, 1981

[86] PCT No.: PCT/EP81/00185

§ 371 Date: Jul. 23, 1982

§ 102(e) Date: Jul. 23, 1982

[87] PCT Pub. No.: WO82/01897

PCT Pub. Date: Jun. 10, 1982

[30] Foreign Application Priority Data

Dec. 5, 1980 [CH] Switzerland ..... 9000/80

[51] Int. Cl.[3] ..... B22F 1/02

[52] U.S. Cl. ..... 75/251; 75/252

[58] Field of Search ..... 75/251–254, 75/0.5 AC, 0.5 BC; 427/34, 423; 423/440

[56] References Cited

U.S. PATENT DOCUMENTS

| | | | |
|---|---|---|---|
| 3,254,970 | 6/1966 | Dittrich et al. | 75/251 |
| 3,305,326 | 2/1967 | Longo | 75/255 |
| 3,372,066 | 3/1968 | Quaas | 148/26 |
| 3,455,019 | 7/1969 | Quaas | 75/255 |
| 4,025,334 | 5/1977 | Cheney et al. | 75/0.5 BC |
| 4,075,371 | 2/1978 | Patel | 427/423 |

FOREIGN PATENT DOCUMENTS

| | | |
|---|---|---|
| 1185034 | 1/1965 | Fed. Rep. of Germany . |
| 1198169 | 8/1965 | Fed. Rep. of Germany . |
| 1441440 | 11/1964 | France . |
| 2317368 | 2/1977 | France . |
| 2021641 | 12/1979 | United Kingdom . |

OTHER PUBLICATIONS

Schwarzkopf, P., et al.; *Refractory Hard Metals Borides, Carbides Nitrides and Silicides,* Macmillan Co., p. 138, (1953).

Kirk–Othmer Encyclopedia of Chemical Technology, 2nd edition, vol. 4, John Wiley & Sons, p. 80, (1963).

*Primary Examiner*—W. Stallard

*Attorney, Agent, or Firm*—Hopgood, Calimafde, Kalil, Blaustein & Judlowe

[57] ABSTRACT

A flame spray powder composition is provided for the thermal coating of workpieces comprising a mechanical mixture of hard particles of material and particles of a matrix-forming self-fluxing alloy selected from the group consisting of Ni-base, Fe-base and Co-base self-fluxing alloys. The hard material is a fused tungsten carbide alloy consisting essentially by weight of about 3 to 7% C, an effective amount of iron ranging up to about 3%, up to about 2% total of other alloying elements and the balance essentially tungsten. Substantially each of the fused tungsten carbide alloy particles is characterized by a metal coating having a melting point higher than the melting point of the self-fluxing alloy and having an average particle size less than about 75 microns. The proportion by weight of the coated hard particles in the mixture ranges from about 10% to 95%, with the balance essentially said self-fluxing alloy. The flame sprayed coating produced from the powder mixture on a workpiece is characterized by a strongly bonded coating having high resistance to abrasion and impact and by uniform properties across the cross section of the coating.

6 Claims, No Drawings

COATING MATERIAL FOR THE FORMATION OF ABRASION-RESISTANT AND IMPACT-RESISTANT COATINGS ON WORKPIECES

The invention relates to a coating material in powder form for the thermal coating of workpieces, said material containing a mechanical mixture of metal powder and a powder of hard material. It is known to provide machine parts subject to heavy wear, by a thermal coating method with a coating in which hard materials are incorporated in order to increase the resistance to abrasion and impact. By way of example, cobalt-bonded tungsten carbide WC or $W_2C$ is deposited by spraying in powder form together with a metal alloy, and the coating is simultaneously or subsequently fused. However, the carbides thereby have a tendency to oxidise and to form intermetallic phases of the form $M_6C$ in the transition zone between the carbide particles and the matrix alloy in which they are incorporated. These intermetallic phases are very brittle and, under shock or impact loading, lead to the breaking off of the carbide particles. Furthermore, it is found that, with the application of such coatings, independently of the specific gravity of the tungsten carbides and the grain size distribution, there is a strong tendency for the carbide particles to sink or settle, so that in relatively thick layers with a thickness of for example 1.0 mm and upwards, the carbide particles are increased in quantity in the bonding zone between the basic material of the workpiece and the desposited coating. As a consequence, the coating or layer is given irregular physical properties and, in particular, presents a surface with a lower carbide content, which is not sufficiently resistant to impact and abrasion.

The invention has for its object to provide a material with which it is possible to produce coatings or layers having very high resistance to abrasion and impact and more particularly layers which, even in relatively great thickness, present constant properties throughout their entire thickness.

This is achieved with a coating material, of the type as initially referred to, by the metal powder consisting of a self-fluxing alloy based on Ni, Fe or Co, the hard material consisting of a fused tungsten carbide alloy with, in percent by weight, 3 to 7% C, 0 to 3% Fe and a maximum of 2% of other alloying elements, the remainder being W, and the particles of hard material comprising a coating of a metal with a higher melting point than that of the said self-fluxing alloy, the grain size of the coated hard material granules being smaller than 75 μm and the proportion of powder of hard material in the mixture with the metal powder being between 10 and 95% by weight.

It has surprisingly been found that, by using fused tungsten carbide alloy powder coated, more particularly, with Ni, Fe or Co, in the proportions as indicated and in the selected grain size, a sinking of the hard material particles during the deposition is avoided and the formation of $M_6C$ compounds is practically completely prevented. A possibly present acicular structure of the fused tungsten carbides further leads to an increase in the toughness of the coating or layer and hence to a further improvement in the resistance to impact and shock loads.

The coating of the hard material particles is advantageously carried out by one of the chemical, electrochemical, CVD, PVD or agglomeration processes which are known per se or an agglomeration process with subsequent sintering.

The grain size of the coated particles of hard maeterial is advantageously smaller than 62 μm and the proportion of the hard powder material in the mixture with the metal powder is advantageously between 40 and 80%.

The following examples indicate various forms of application and use of the invention, which may, however, in each given case, be modified in many ways, according to the particular requirements of the respective strain or load.

EXAMPLE 1

A fused tungsten carbide alloy having the composition of 4.0% C, 0.3% Fe, the remainder W, was obtained by fusion in an induction furnace, thereafter crushed in a hammer mill and screened to a grain size smaller than 75 μm. After the screening, the particles of hard material were coated with 10% nickel, using an electrochemical process.

The powder of hard material as thus obtained was thereafter mixed in the ratio of 60% to 40% with an alloy having the composition of 0.2% C, 3.0% Si, 1.5% Cr, 1.0% Fe, the remainder being Ni. This powder mixture was sprayed with a flame-spraying gun on to a machine part and thereafter fused. During the subsequent machining, grinding and polishing, and also with the machine in use, it was not possible to detect any breaking off of the hard constituents from the layer or coating. Microscopic examination showed no brittle intermetallic phase in the transition zone between the formed metallic matrix and the alloy particles of the fused tungsten carbide. As compared with a part or component provided with a conventional coating, the life of the machine part was increased three-fold.

EXAMPLE 2

A fused tungsten carbide alloy, fused in the induction furnace and having the composition of 5.5% C, 2.8% Fe, 1.0% V, the remainder being W, was crushed in a ball mill, and thereafter coated with 20% cobalt powder, grain size 1 to 10 μm, and a stearate, by agglomeration. Thereafter, the stearate was vaporised in the furnace and the hard powder material was sintered at a temperature of 1300°–1400° C. in a reducing atmosphere. Thereafter, the powder as thus produced was screened to a grain size smaller than 45 μm and mixed with an alloy having the composition of 1.0% C, 25.0% Cr, 15.0% Ni, 5.0% Mo, the remainder being Co, in the ratio of 30% powder of hard material to 70% metal alloy.

Using this powder mixture, a component subjected to wear was coated by the flame-spraying method with simultaneous fusion. After a relatively long time of use under an impact and shock load, it was not possible to detect any cracks and broken-off particles. Examination under a microscope showed a uniform distribution of the particles of hard material in the coating.

EXAMPLE 3

A fused tungsten carbide alloy with the composition of 3.0% C, 1.5% Fe, 1.0% Mo, 0.5% V, 0.2% Nb, the remainder being W, was fused in an arc furnace and therafter crushed by a conventional method. The powder as thus obtained was screened to a grain size smaller than 62 μm and coated, using the CVD process, with 2% Ni.

This powder of hard material was mixed in a ratio of 80% to 20% with a metal powder of a self-fluxing alloy, having the composition of 1.0% C, 17.0% Cr, 3.1% B, 4.2% Si, 5.0% Fe, the remainder being Ni.

This mixture was applied in a plasma spraying installation to a fan blade in a coating or layer thickness of 1.0 mm and thereafter fused in the furnace under protective gas. After machining, the layer as thus produced did not show any broken-off particles and cracks. Even after relatively long use, no defects were detected which could be related to formation of a brittle phase.

A preferred self-fluxing alloy used in the flame spray powder is one consisting essentially by weight of 0.2 to 18% Cr, 1.5 to 4.5% B, 1 to 4.5% Si, 0.1 to 1.5% C, 0.2 to 20% Fe and the balance essentially nickel.

Another preferred self-fluxing alloy is one containing 10 to 35% Cr, 0.2 to 30% Ni, 0.05 to 1.5% C, 0 to 1.5% W, 0 to 10% Mo and the balance essentially Co.

As stated previously, the metal coating for the fused tungsten carbide alloy may be a metal selected from the group consisting of Ni, Fe and Co, the percent by weight of the coating on the tungsten carbide alloy particles being preferably 2 to 20%.

As will be clearly apparent from Examples 1 to 3, the fused tungsten carbide alloy preferably contains effective amounts of iron as an alloying ingredient, among small amounts of other alloying additions, such as V, Mo and Nb, the total of other elements not exceeding about 2%. Thus, in Example 1, the fused tungsten carbide alloy contains 0.3% Fe; in Example 2, the fused tungsten carbide alloy contains 2.8% Fe; and in Example 3, the amount of iron is 1.5% Fe. A preferred fused tungsten carbide alloy composition is one containing 3.5 to 5.5% C, a maximum of 0.2% Fe and a maximum 0.1% of other elements.

We claim:

1. A flame spray powder composition for the thermal coating of workpieces comprising a mechanical mixture of hard particles of material and particles of a matrix-forming self-fluxing alloy selected from the group consisting of Ni-base, Fe-base and Co-base self-fluxing alloys, said hard material being a fused tungsten carbide alloy consisting essentially by weight of about 3 to 7% C, from 0 to about 3% iron, up to about 2% total of other alloying elements and the balance essentially tungsten, substantially each of said fused tungsten carbide alloy particles being characterized by a coating of about 2 to 20% by weight of a metal selected from the group consisting of Ni, Fe and Co having a melting point higher than the melting point of the self-fluxing alloy and having an average particle size less than about 75 microns, the proportion by weight of the coated hard particles in the mixture ranging from about 10% to 95%, with the balance of the mixture essentially said self-fluxing alloy.

2. The flame spray powder composition of claim 1, wherein the metal coating on the fused tungsten carbide alloy particles in the powder mixture is selected from the group consisting of Ni, Fe, and Co, and wherein the self-fluxing alloy is a nickel-base alloy containing about 0.2 to 18% Cr, about 1.5 to 4.5% B, about 1 to 4.5% Si, about 0.01 to 1.5% C, about 0.2 to 20% Fe and the balance essentially Ni.

3. The flame spray powder composition of claim 1, wherein the metal coating on the fused tungsten carbide alloy particles in the powder mixture is selected from the group consisting of Ni, Fe and Co, and wherein the self-fluxing alloy is a cobalt-base alloy containing about 10 to 35% Cr, about 0.2 to 30% Ni, about 0.05 to 1.5% C, 0 to about 1.5% W, 0 to about 10% Mo and the balance essentially Co.

4. The flame spray powder of claim 1, wherein the fused tungsten carbode alloy in the powder mixture consists essentially by weight of about 3.5 to 5.5% C, up to about 0.2% Fe, a maximum of about 0.1% of other elements, and the balance essentially tungsten.

5. The flame spray powder of claim 1, wherein the average particle size of the coated hard material in the powder mixture is less than about 62 microns.

6. The flame spray powder of claim 1, wherein the proportion by weight of the coated hard material in the powder mixture ranges from about 40 to 80%, and the balance essentially said self-fluxing alloy.

* * * * *